US007322467B2

(12) United States Patent
Youngblood

(10) Patent No.: US 7,322,467 B2
(45) Date of Patent: Jan. 29, 2008

(54) TISSUE BOX CADDY

(75) Inventor: David Youngblood, Clinton Township, MI (US)

(73) Assignee: Tissue Box Caddy, LLC, Clinton Township, MI (US)

( * ) Notice: Subject to any disclaimer, the term of this patent is extended or adjusted under 35 U.S.C. 154(b) by 119 days.

(21) Appl. No.: 11/063,034

(22) Filed: Feb. 20, 2005

(65) Prior Publication Data

US 2005/0183972 A1 Aug. 25, 2005

Related U.S. Application Data

(60) Provisional application No. 60/546,050, filed on Feb. 19, 2004.

(51) Int. Cl.
*B65D 6/00* (2006.01)

(52) U.S. Cl. ..... 206/233; 206/806; 220/482; 220/751; 220/8

(58) Field of Classification Search ..... 206/233, 206/494, 806; 221/45, 34, 98, 199; D6/519; 220/23.4, 23.2, 23.91, 8, 482, 751; 224/268, 224/269

See application file for complete search history.

(56) References Cited

U.S. PATENT DOCUMENTS 1,827,396 A * 10/1931 Luckett ..... 220/8
3,245,580 A 4/1966 Campanella
3,395,787 A * 8/1968 Plaskan ..... 206/259
3,987,993 A * 10/1976 Hopkins ..... 248/210
4,919,302 A 4/1990 McPherson ..... 221/34
D312,934 S 12/1990 Shapland et al. ..... D6/519
5,054,612 A 10/1991 Meyer, Jr. ..... 203/233
5,192,019 A * 3/1993 Meehan ..... 229/101
5,660,298 A * 8/1997 Thompson ..... 220/482
5,727,649 A * 3/1998 Buckley ..... 182/129
5,875,912 A * 3/1999 Hobson ..... 220/4.03
6,202,874 B1 * 3/2001 Diamond ..... 220/4.03
6,305,591 B1 * 10/2001 Jones ..... 224/601
6,588,616 B1 * 7/2003 Ho ..... 220/4.03
2003/0173359 A1 * 9/2003 Nester et al. ..... 220/23.4

FOREIGN PATENT DOCUMENTS

JP 63057051 A * 3/1988

* cited by examiner

*Primary Examiner*—Mickey Yu
*Assistant Examiner*—Steven A. Reynolds
(74) *Attorney, Agent, or Firm*—Gifford, Krass, Sprinkle, Anderson & Citkowski, P.C.

(57) ABSTRACT

A receptacle stores and keeps items, such as toiletries and medicine, within close proximity to a tissue box. The receptacle includes a bottom wall, a plurality of walls and a hook element. The plurality of walls extends outwardly from the bottom wall to define a storage space. The hook element has an edge for forming a hole in a top surface of the tissue box.

8 Claims, 3 Drawing Sheets

TISSUE BOX CADDY

REFERENCE TO RELATED APPLICATIONS

This application also claims priority from U.S. Provisional Patent Application Ser. No. 60/546,050, filed Feb. 19, 2004, the content of which is incorporated herein by reference in its entirety.

BACKGROUND OF THE INVENTION

1. Field of the Invention

The invention relates to accessories for tissue boxes. Specifically, the invention relates to a box or a container that can be secured to a tissue box for storing miscellaneous items therein.

2. Description of the Related Art

Typically, tissue boxes are made of cardboard with an opening formed on a top side thereof for dispensing tissues. It is well known to provide a decorative rigid cover that goes over the entire box and the cover itself includes an opening which corresponds to the opening in the top of the tissue box, but it remains desirable to provide a means of storage for miscellaneous items in the proximity of the tissue box such as a toothbrush, toothpaste, or thermometer.

SUMMARY OF THE INVENTION

According to one aspect of the invention, a receptacle is provided for storing and keeping items within close proximity to a tissue box. The receptacle includes a bottom wall, and a hook element. At least one wall extends outwardly from the bottom wall to define a storage space. The hook element extends outwardly from the at least one wall. The hook has an edge for forming a hole in a top surface of the tissue box.

According to another aspect of the invention, a receptacle is provided for storing and keeping items within close proximity to a tissue box. The receptacle includes a bottom wall, and a hook element. At least one wall extends outwardly from the bottom wall to define a storage space. The hook element is pivotally coupled to the at least one wall for movement between a use position extending outwardly from the at least one wall and a stowed position disposed alongside the at least one wall.

According to another aspect of the invention, a receptacle is provided for storing and keeping items within close proximity to a tissue box. The receptacle includes an upper half having a hook element extending outwardly therefrom for attaching the receptacle to the tissue box. The receptacle also includes a lower half cooperative with the upper half to form a storage space for storing the items therein. The lower half is slidably coupled to the upper half so that the height of the receptacle is adjustable to correspond with the height of the tissue box.

BRIEF DESCRIPTION OF THE DRAWINGS

Advantages of the present invention will be readily appreciated as the same become better understood by reference to the following detailed description when considered in connection with the accompanying drawings wherein.

DETAILED DESCRIPTION OF THE INVENTION

An embodiment of the present invention provides a receptacle or "caddy" that is attachable to a tissue box. Described in greater detail below, the caddy is attached to the tissue box utilizing a hook that hooks around an edge of a hole in a top surface of the tissue box. The caddy also includes a pocket or storage space for storing items, such as toiletries and medicine within convenient proximity to the tissue box.

Figure 2:
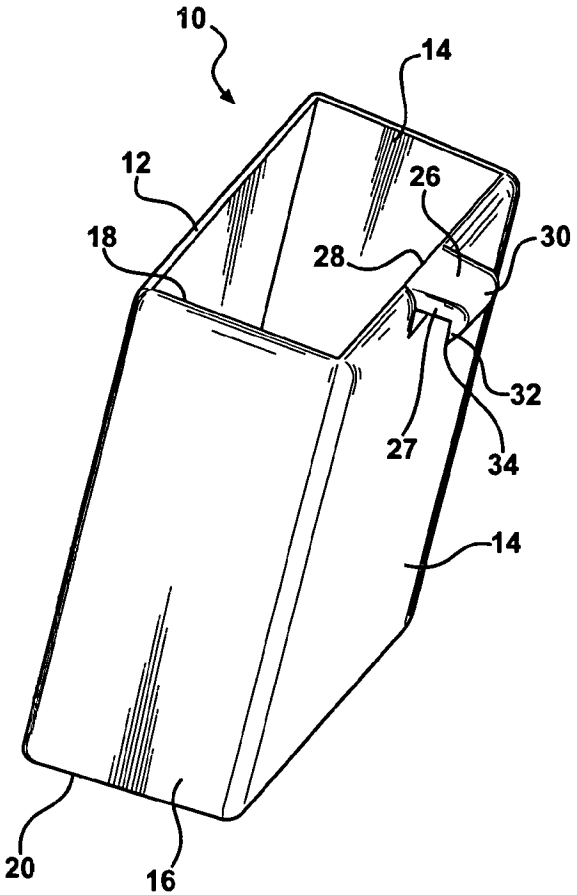
FIG. 2 is a rear perspective view of the tissue box caddy according to the first preferred embodiment of the invention.
Figure 1:
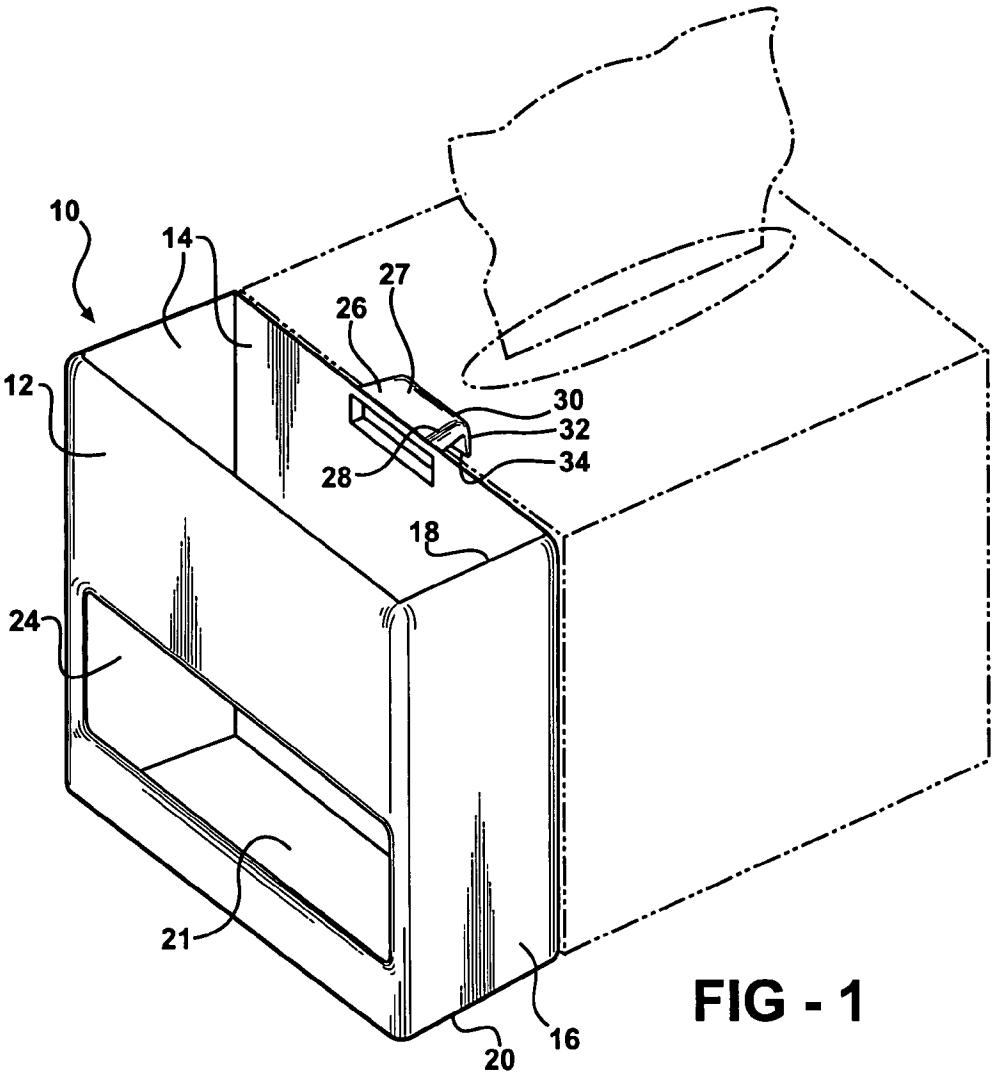
FIG. 1 is a perspective view of a tissue box caddy according to a first preferred embodiment of the invention.

Referring to FIGS. 1 and 2, a tissue box caddy is generally indicated at 10. The caddy 10 includes spaced apart front 12 and back 14 walls 12 and 14. The caddy 10 also includes spaced apart sidewalls 14, 16 extending orthogonally between the front 12 and back 14 walls. Each of the front 12 and back 14 walls and the sidewalls 14, 16 extend between an upper end 18 and a lower end 20. The caddy 10 also includes a floor or bottom wall 21 that closes the lower end 20 of the caddy 10. The bottom wall 21 extends orthogonally between the front 12 and back 14 walls and the sidewalls 14, 16. The front 12 and back 14 walls, the sidewalls 14, 16 and the bottom wall 21 define a compartment or storage space 22. The upper end 18 of the caddy 10 remains open to allow access into the storage space 22. Preferably, an opening 24 is defined in the front wall 12 that facilitates access into the storage space 22.

A hook element 26 is defined along the upper end 18 of the back wall 14. The hook element 26 includes a flange 27 extending between a proximal end 28 fixedly secured to the upper end 18 of the back wall 14 and an opposite distal end 30. An end wall 32 extends orthogonally from the distal end 30 of the flange 27. The end wall 32 is spaced apart from the back wall 14 and is generally parallel with the back wall 14. The end wall 32 includes an edge 34. Optionally, the edge 34 is sharp or serrated to facilitate cutting into cardboard material of a tissue box.

In use the back wall 14 is placed adjacent to one of the side walls of a tissue box. The caddy 10 is pushed downwardly such that the edge 34 pierces a top surface of the tissue box. A hole or an aperture in the top surface of the tissue box such that the hook element 26 remains in hooked engagement with the tissue box. The opening at the upper end 18 of the caddy 10 and the opening 24 in the front wall 12 allows placement and removal of miscellaneous items from the storage space 22.

Preferably, the caddy 10 is produced out of injection molded plastic but may also be produced out of any suitable rigid material such as stainless steel, aluminum or the like.

Figure 3:
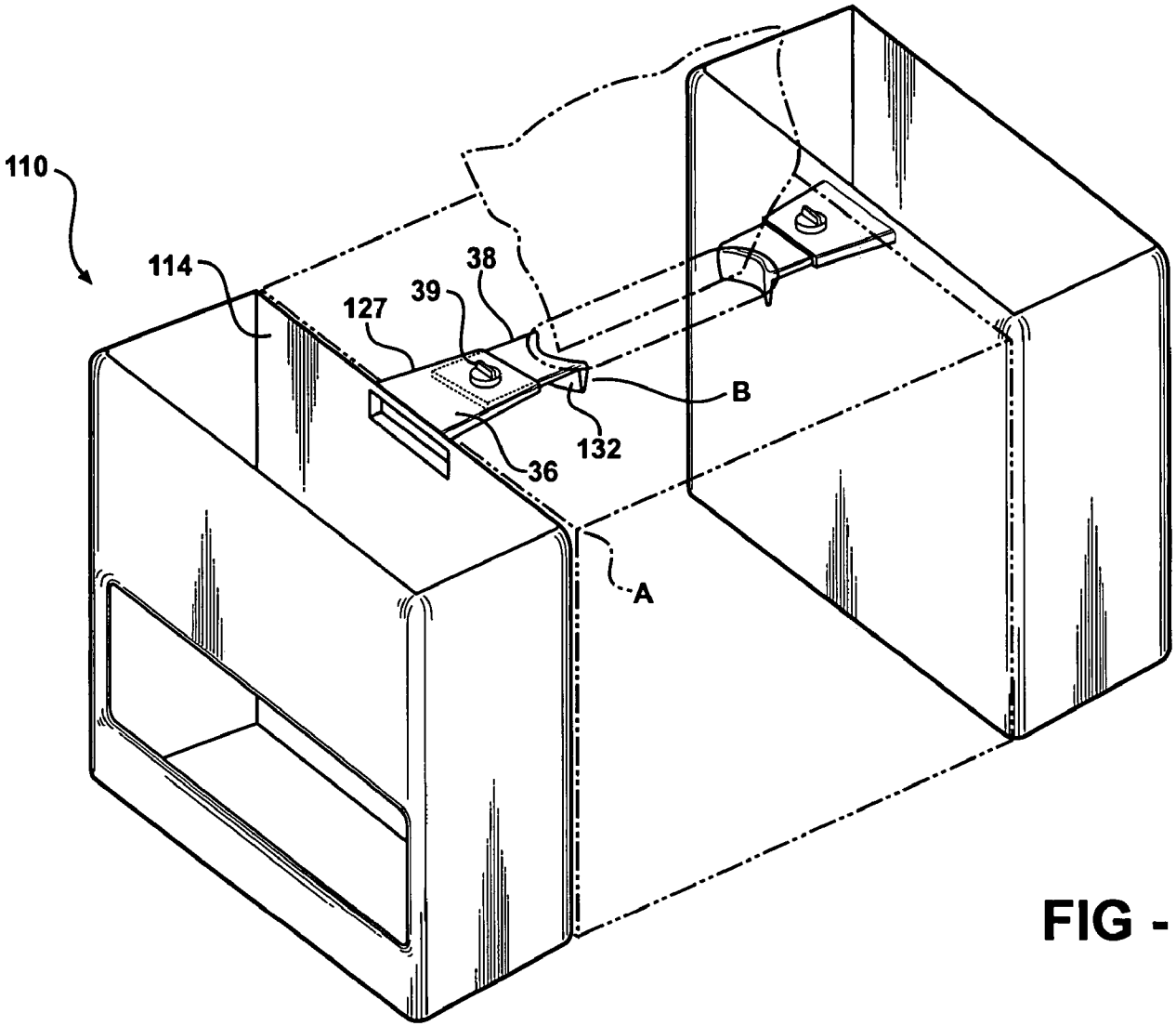
FIG. 3 is a perspective view of the tissue box according to a second embodiment of the invention, wherein an adjustable hook is provided for hooking the box onto a preexisting aperture in the tissue box.

Referring to FIG. 3, a second embodiment of the caddy is generally indicated at 110, wherein like components and features are indicated by numerals offset by 100. The caddy 110 includes a flange 127. The flange 127 has a length corresponding with the distance between an edge A of the tissue box and an edge B of a pre-existing opening in the tissue box, so as to allow the end wall 132 to extend into the pre-existing opening in the tissue box. Preferably, the flange 127 includes a fixed section 36 fixedly secured to the back wall 114 and an adjustable section 38 slidably engaged with the fixed section 36. The end wall 132 extends orthogonally from the adjustable section 38 for movement therewith relative to the fixed section 36. By this arrangement, the position of the end wall 132 relative to the back wall 114 can be adjusted to accommodate a variety of tissue box sizes and pre-existing opening sizes. Preferably, a set screw 39 is threadingly engaged with the fixed section 36. An end of the set screw 39 is driven into the adjustable section 38 as the set screw 39 is tightened relative to the fixedly section 36. Thus, tightening the set screw 39 locks the position of the adjustable section 38 relative to the fixed section 36. Optionally, locking tabs and detents, instead of the set screw 39, can be used to create sufficient friction to maintain the position of the adjustable section 38 relative to the fixed section 36.

Figure 4:
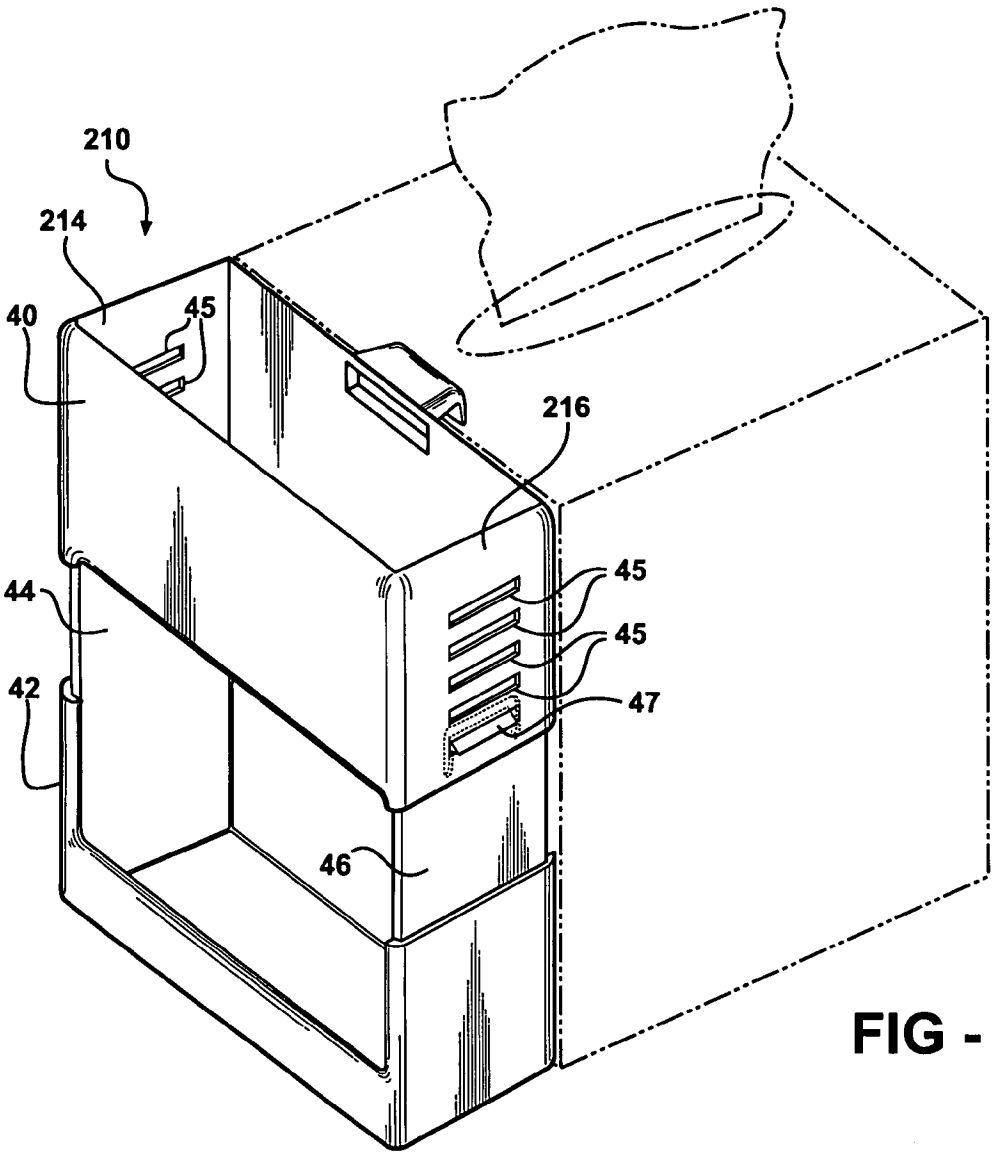
FIG. 4 is a perspective view of the tissue box according to a third embodiment of the invention, wherein the height of the caddy is adjustable to accommodate boxes of various heights.

Referring to FIG. 4, a third embodiment of the caddy is generally indicated at 210. The caddy 210 includes upper 40 and lower 42 halves that are slidably coupled to one another to allow adjustment of the overall height of the caddy 210 to accommodate tissue boxes of varying heights. More specifically; the lower half 42 of the caddy 210 includes substantially parallel legs 44, 46 extending upwardly toward the upper half 40 of the caddy 210. The legs 44, 46 are spaced apart. The legs 44, 46 are slidably engaged with the side walls 214, 216 of the upper half 40 of the caddy 210. Detents 45 are formed in the side walls 214, 216 for engaging protrusions or tabs 47 extending outwardly from each of the side walls 214, 216. The engagement between the detents 45 and tabs 47 locks the relative positions of the lower half 42 relative to the upper half 40 of the caddy 210. Further, the engagement between the detents 45 and tabs 47 supports the weight of items that will be typically stored in the caddy 210, such as toiletries and medicine.

Figure 5:
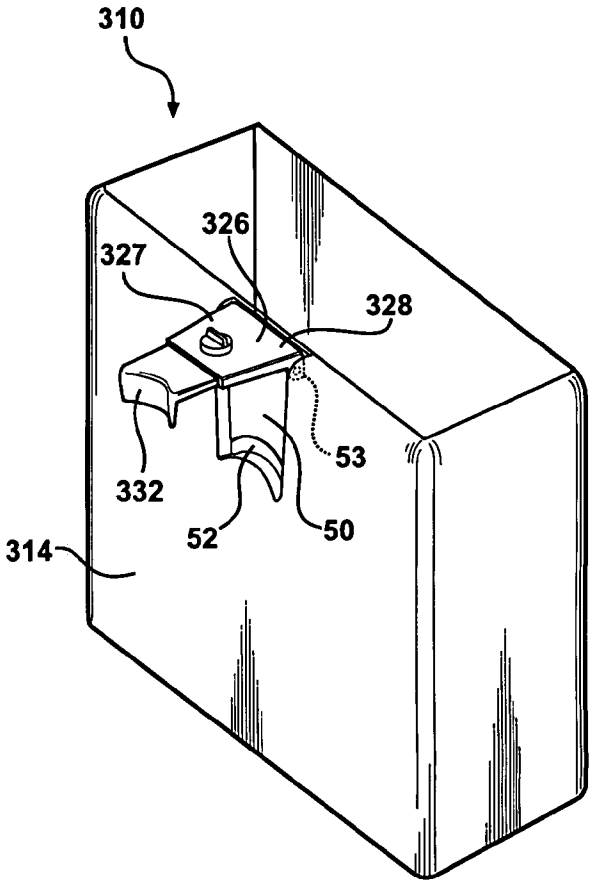
FIG. 5 is an enlarged perspective view of the tissue box according to a fourth embodiment of the invention, wherein the hook is rotatable between a use position and a stowed position.

Referring to FIG. 5, a fourth embodiment of the caddy is generally indicated at 310, wherein the hook element 326 is rotatably coupled to the back wall 14. More specifically, the proximal end 328 of the flange 327 is rotatably coupled to the back wall 314 by a pivot pin 53 for movement between a use position (indicated at X in FIG. 5) extending outwardly from the back wall 314 and a stowed position (indicated at Y in FIG. 5) disposed within a recess 50 formed in the back wall 314. A slot 52 is formed in the back wall 314 for receiving the end wall 332 therethrough when the hook element 326 is in the stowed position, so that the flange 327 is substantially flush with an outer surface of the back wall 314.

The invention has been described in an illustrative manner. It is therefore to be understood that the technology used is intended to be in the nature of words of description rather than a limitation. Many modifications and variations of the invention are possible in light of the above teachings. Thus, within the scope of the appended claims the invention may be practiced other than as specifically described.

The invention claimed is:

1. A receptacle for storing and keeping items within close proximity to a tissue box, said receptacle comprising:

a bottom wall;

a plurality of side walls extending generally orthogonally from said bottom wall to define a box having a storage space and a top opening for accessing said storage space, a first wall of said plurality of side walls having a side opening that provides additional access to said storage space; and a hook element pivotally coupled to a second wall of said plurality of walls, wherein said first and second walls are generally parallel and spaced apart from each other, the hook element being movable between a use position extending outwardly from said second wall and a retracted position disposed alongside said second wall, wherein said second wail includes a recess for receiving said hook element in said retracted position so that said hook element is substantially coplanar with the second wall in the retracted position.

2. A receptacle as set forth in claim 1, wherein said hook element includes a flange extending outwardly from said second wall, said hook further including an end wall protruding outwardly from a distal end of said flange for extending through a preformed hole in a top surface of the tissue box, said end wall being arcuately shaped to conform with a perimeter edge of the preformed hole.

3. A receptacle as set forth in claim 1, wherein said hook element includes an end wall disposed at a distal end of an outwardly extending flange, said end wall having a sharp or serrated edge for forming and extending through a hole in a top surface of the tissue box to secure the receptacle to the tissue box.

4. A receptacle for storing and keeping items within close proximity to a tissue box, said receptacle comprising:

a bottom wall;

a plurality of side walls extending generally orthogonally from said bottom wall to define a box having a storage space and a top opening for accessing said storage space, a first wall of said plurality of side walls having a side opening that provides additional access to said storage space; and a hook element pivotally coupled to a second wall of said plurality of walls, wherein said first and second walls are generally parallel and spaced apart from each other, the hook element being movable between a use position extending outwardly from said second wall and a retracted position disposed alongside said second wall, wherein said hook element includes an end wall disposed at a distal end of an outwardly extending flange, said second wall having a slot for receiving said end wall therein when said hook element is in said retracted position so that said hook element is substantially coplanar with the second wall in the retracted position.

5. A receptacle for storing and keeping items within close proximity to a tissue box, said receptacle comprising:

an upper half having a hook element extending outwardly therefrom for hookingly attaching said receptacle to the tissue box, and having a top opening;

a lower half cooperative with said upper half to form a storage space for storing the items therein, said lower half being slidably coupled to said upper half so that the height of said receptacle is adjustable to correspond with the height of the tissue box, said lower half having a first edge, said upper half having a second edge, said first edge and said second edge being substantially coplanar and spaced apart to define a side opening that provides side access to said storage space and varies in size in proportion with the height of said receptacle.

6. A receptacle as set forth in claim 5, wherein said upper half includes access to said storage space, said top opening and side opening being substantially orthogonal relative to each other.

7. A receptacle as set forth in claim 5, wherein said lower half includes spaced apart legs slidably engaged with respective side wails of said upper half.

8. A receptacle as set forth in claim 7, wherein one of said legs and said side walls includes a protrusion the creates sufficient friction to maintain the relative position of said lower half with respect to said upper half.

* * * * *

UNITED STATES PATENT AND TRADEMARK OFFICE

CERTIFICATE OF CORRECTION

PATENT NO. : 7,322,467 B2
APPLICATION NO. : 11/063034
DATED : January 29, 2008
INVENTOR(S) : Dave Youngblood It is certified that error appears in the above-identified patent and that said Letters Patent is hereby corrected as shown below:

Column 4, Line 18, replace “second wail” with --second wall--

Signed and Sealed this

Tenth Day of June, 2008

JON W. DUDAS
*Director of the United States Patent and Trademark Office*